US010076787B2

(12) United States Patent
Volker et al.

(10) Patent No.: US 10,076,787 B2
(45) Date of Patent: Sep. 18, 2018

(54) METHOD FOR THE PRODUCTION OF A METAL BEARING LAYER ON A CYLINDER BARREL OF A HYDROSTATIC DISPLACEMENT MACHINE

(71) Applicant: Linde Hydraulics GmbH & Co. KG, Aschaffenburg (DE)

(72) Inventors: Klaus Volker, Grossostheim (DE); Jens Gabelmann, Frankfurt (DE); Klaus Syndikus, Aschaffenburg (DE); Sebastian Weber, Laufach (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 358 days.

(21) Appl. No.: 14/493,380

(22) Filed: Sep. 23, 2014

(65) Prior Publication Data

US 2015/0132176 A1 May 14, 2015

(30) Foreign Application Priority Data

Oct. 8, 2013 (DE) ..... 10 2013 111 134

(51) Int. Cl.

| | |
|---|---|
| ***B22F 7/02*** | (2006.01) |
| ***B22F 3/12*** | (2006.01) |
| ***B22F 5/00*** | (2006.01) |
| ***B22F 7/06*** | (2006.01) |
| *B22F 5/10* | (2006.01) |

(52) U.S. Cl.

CPC ..... *B22F 7/02* (2013.01); *B22F 3/12* (2013.01); *B22F 5/00* (2013.01); *B22F 5/008* (2013.01); *B22F 7/06* (2013.01); *B22F 5/10* (2013.01); *B22F 2998/10* (2013.01)

(58) Field of Classification Search

CPC ..... B22F 7/06; B22F 7/02

See application file for complete search history.

(56) References Cited

U.S. PATENT DOCUMENTS 2,753,858 A * 7/1956 Honeyman ..... B30B 11/027 123/188.8
6,316,393 B1 * 11/2001 Thomas ..... B22F 1/0059 508/150

FOREIGN PATENT DOCUMENTS

| | | | |
|---|---|---|---|
| DE | 2431254 | A1 | 1/1976 |
| DE | 102008027698 | A1 | 12/2009 |
| DE | 102008027700 | A1 | 12/2009 |

* cited by examiner

*Primary Examiner* — Weiping Zhu
(74) *Attorney, Agent, or Firm* — The Webb Law Firm

(57) ABSTRACT

A method for the production of a metal bearing layer (L) on a cylinder barrel (3) of a hydrostatic displacement machine (1), in particular of an axial piston machine, in which the metal bearing layer (L) is produced from a sintering powder in a sintering process. In a first production step, a dimensionally stable green compact (31) is produced from a sintering powder by a cold pressing process. In a second subsequent production step, the green compact (31) produced by the cold pressing process is sintered onto the cylinder barrel (3) in a sintering process.

17 Claims, 2 Drawing Sheets

METHOD FOR THE PRODUCTION OF A METAL BEARING LAYER ON A CYLINDER BARREL OF A HYDROSTATIC DISPLACEMENT MACHINE

CROSS REFERENCE TO RELATED APPLICATION

This application claims priority to German Application No. DE 102013111134.3 filed Oct. 8, 2013, which is herein incorporated by reference in its entirety.

BACKGROUND OF THE INVENTION

Field of the Invention

This invention relates to a method for the production of a metal bearing layer on a cylinder barrel of a hydrostatic displacement machine, in particular of an axial piston machine, in which the metal bearing layer is produced from a sintering powder in a sintering process.

Description of Related Art

On hydrostatic displacement units, such as axial piston machines or radial piston machines, a sliding contact bearing area is located in the reversing mechanism in the vicinity of a control surface between the cylinder barrel and a housing-side manifold. On displacement units of this type, there is a relative movement between the cylinder barrel (provided with the pistons and the displacement chambers) and the housing-side manifold (provided with a low-pressure connection and a high-pressure connection). The connection of the piston bores, and thus the connection of the displacement chambers in the cylinder barrel, with the low-pressure connection and the high-pressure connection in the housing-side manifold is reversed as the piston movement proceeds through the dead center points. To achieve favorable sliding properties and low wear between the cylinder barrel and the housing-side manifold at this sliding contact bearing area, this reversal is realized by a material pairing of a tribologically advantageous layer with a counter-rotation hearing surface made of steel or a cast material. It is known that a bearing metal material can be deposited on the end surface of the cylinder barrel to create a tribologically advantageous, e.g., a low friction, layer.

In known hydrostatic displacement units, the metal bearing layer on a sliding contact bearing component formed by a steel body of the corresponding sliding contact bearing area is applied by a casting process or by a sintering process.

From DE 24 31 254 A1, DE 10 2008 027 698 A1, and DE 10 2008 027 700 A1, it is known that the metal bearing layer can be deposited on the end surface of the cylinder barrel of a hydrostatic displacement machine by a sintering process. A mold element in the form of a sintering ring is placed on the cylinder barrel and a sintering powder is filled into the cavity created by the sintering ring. Two successive filling processes with sintered powder can be carried out to improve the properties of the metal bearing layer by means of a two-layer charge of packed powder. The packed powder charge is then compacted in a compacting machine and sintered. These processes can be carried out simultaneously by performing the sintering with the simultaneous application of pressure and heating to the sintering temperature in a pressure sintering device. This process is also called pressure sintering.

With a manufacturing method of this type, however, the uniformity of the filling of the cavity created by the sintering ring placed over the cylinder barrel fluctuates a great deal.

This results in a dispersion of the physical properties of the metal bearing layer on the cylinder barrel.

During pressure sintering, the force with which the sintering powder charge is compacted by the pressure sintering device is also limited.

A great deal of dust is also generated during the compacting of the sintering powder charge applied to the cylinder barrel. To reduce the amount of dust generated, ethanol or glycol as additives can be added to the sintering powder. However, the addition of ethanol or glycol makes the sintering powder more expensive. The large amount of dust generated also results in a loss of sintering powder represented by the dust, which further increases production costs. The large amount of dust generated also requires employees to permanently wear protective respiratory equipment. With these additives in the sintering powder, the amount of dust generated during the compacting of the sintering powder charge can be reduced, although the additives ethanol or glycol have additional disadvantages in terms of the coating quality of the sintering powder charge. The layer of powder can be non-uniform, in particular, in the radially outer peripheral areas and, thus, in the load-bearing web area of the cylinder barrel. The additives ethanol or glycol in the sintering powder on one hand interfere with the pourability of the sintering powder during the process of filling the sintering ring and, on the other hand, evaporate due to high temperatures during the sintering process. As a result, small cavities are formed in the metal bearing layer. When the sintering powder is a bronze powder that contains lead, e.g., a mixture of copper, tin, and lead, these cavities are filled with lead during the sintering process because lead is not fully incorporated into the alloy and is present as a separate liquid phase, causing local decreases in hardness to occur in the sintered metal bearing layer. Overall, with the known pressure sintering processes there can be quality problems with the metal hearing layer applied to the cylinder barrel.

It is an object of this invention to provide a method for producing a metal bearing layer on a cylinder barrel of a hydrostatic displacement machine, in particular of an axial piston machine, with which the metal bearing layer on the cylinder barrel can be produced with high quality, at low production costs, and with a reduced quantity of generated dust.

SUMMARY OF THE INVENTION

The invention teaches that this object is accomplished by a method in which, in a first production step, a dimensionally stable green compact is produced from a sintering powder by a cold pressing process. In a second production step, the green compact produced by the cold pressing process is sintered onto the cylinder barrel in a sintering process.

In the production method of the invention, a dimensionally stable green compact is pressed from the sintering powder in a cold pressing process and is then sintered onto the cylinder barrel in a sintering process. Compared to the known production methods in which the powder charge applied to the cylinder barrel is compacted using only a small amount of force, in the method of the invention, a dimensionally stable green compact is produced from the sintering powder in the cold pressing process at a pressure which is a multiple of the pressure applied by a compacting machine in the known production methods of the prior art. The green compact produced in the cold pressing process can then be sintered onto the cylinder barrel in a separate sintering process. The cold pressing process is characterized by the fact that a lower quantity of dust and dust pollution is generated during the production of the metal bearing layer on the cylinder barrel. This feature reduces both the quantity of dust to which the employees are exposed and the loss of sintering powder, which results in lower production costs. In addition, green compacts of high quality and high repeatability can be produced in the cold pressing process, as a result of which the quality of the metal bearing layer produced on the cylinder barrel is increased.

The dimensionally stable green compact is advantageously produced by a cold press using the cold pressing process. With a cold press, high levels of force can be applied with little effort to press dimensionally stable green compacts out of the sintering powder.

With regard to the use of a small amount of material for the sintering powder, it is advantageous if a disk-shaped green compact is produced in the cold pressing process. A disk-shaped green compact forms a powder tablet that can be adapted to the dimensions of the rotating cylinder barrel.

It is particularly advantageous if, as in one embodiment of the invention, the cold pressing process is carried out using dry sintering powder. With the method of the invention, a dry sintering powder can be used for the production of the green compact from the sintering powder in the cold pressing process, i.e., a sintering powder that does not contain additional additives, such as ethanol or glycol. This results in reduced costs on account of the lower cost of procurement of the dry sintering powder without additives. One significant advantage is that with the use of dry sintering powder, a uniform filling in the cold press can be achieved because dry sintering powder can be poured more easily and more uniformly into the specified mold of the cold press. This results in a high degree of uniformity of the metal bearing layer produced on the cylinder barrel and improved quality. Because the dry sintering powder flows more uniformly, the quantity of sintering powder required for the production of the metal bearing layer can also be reduced in comparison to previously known methods of the prior art, which results in a further cost savings.

Additional advantages can be achieved if, as in one development of the invention, a press form with a predefined filling volume is filled with the sintering powder in the cold pressing process.

A specified pressure force is then applied to a pressing tool formed by an upper punch and a lower punch and the displacement of the pressing tool is measured.

It is particularly advantageous if additional sintering powder is added in the event to the change in the displacement of the pressing tool under the specified pressing force.

The fill volume is determined by the cold press. After the filling of the press form with sintering powder, a compacting process at the specified pressing force is conducted to produce the green compact, in which the press form and the sintering powder are pressurized at a specified pressing force by the upper punch and the lower punch. The displacement of the punches of the pressing tool required for this purpose is measured by the cold press. If the displacement necessary to achieve the specified pressing force or the specified pressure changes, the amount of sintering powder added can be automatically adjusted by the cold press for the manufacture of the subsequent green compact by increasing or decreasing the fill volume.

This measure detects and compensates for any variation of the bulk density of the sintering powder. It thereby becomes possible to achieve a high and uniform quality of the metal bearing layer produced on the cylinder barrel.

Alternatively, the green compact produced by the cold pressing process can be weighed after the cold pressing.

A determination of the weight of the green compact produced in the cold pressing process by a weighing process makes it possible to detect any variation in the bulk density of the sintering powder. When a variation of the bulk density of the sintering powder is detected, corresponding countermeasures can be taken. For example, the amount of sintering powder added can be adjusted to achieve a high uniform quality of the metal bearing layer produced on the cylinder barrel.

The pressing process is advantageously monitored during the cold pressing process. An appropriate sensor system makes it possible to monitor the cold pressing process in a simple manner, as a result of which a high level of reproducibility of the cold pressing process is achieved and green compacts of high and uniform quality can be produced which result in a high and uniform quality of the metal bearing layer produced on the cylinder barrel.

In the production method of the invention, the green compact produced in the cold pressing process is placed on the end surface of the cylinder barrel for the sintering process. This results in the easy and improved handling of the components because, compared to the known production methods in which the cylinder barrel with the powder charge must be handled as part of the sintering process, in the production method of the invention, the only handling operation that is necessary is the placement of the dimensionally stable green compact on the cylinder barrel for the sintering process.

BRIEF DESCRIPTION OF THE DRAWINGS

Additional advantages and details of the invention are explained in greater detail below with reference to the accompanying schematic figures, in which like reference numbers identify like parts throughout.

DESCRIPTION OF THE PREFERRED EMBODIMENTS

Figure 1:
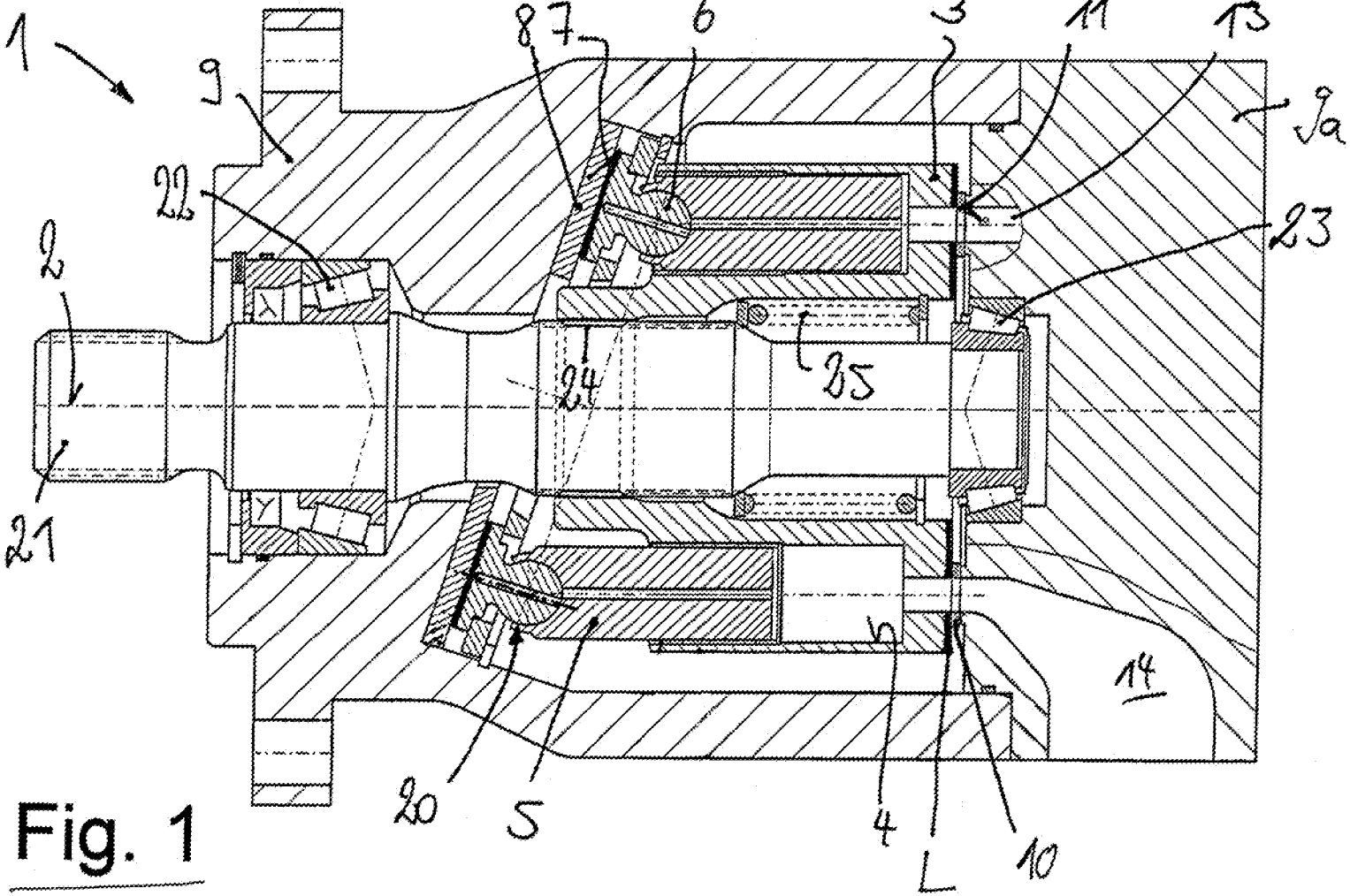
FIG. 1 shows a displacement machine of the invention in a longitudinal section.

FIG. 1 shows a hydrostatic displacement machine 1 of the invention in a longitudinal section. The illustrated exemplary embodiment shows an axial piston machine utilizing a swashplate design as an example of the displacement machine 1.

The displacement machine 1 has a cylinder barrel 3 mounted so that it can rotate around an axis of rotation 2. The cylinder barrel 3 is provided with a plurality of piston bores 4 arranged concentrically with the axis of rotation 2. The piston bores 4 are preferably formed by cylinder bores. A piston 5 is mounted in each piston bore 4 so that it can move longitudinally.

The pistons 5 are supported in the area that protrudes out of the cylinder barrel 3 by a support element in the form of the slipper 6 in contact with a track 7 that causes their displacement. The track 7 is formed by a swashplate 8 which is installed non-rotationally around the axis of rotation 2.

The swashplate 8 can be formed or non-rotationally fastened onto a housing 9 of the displacement machine 1, in which case the displacement machine 1 has a fixed displacement volume.

It is alternatively possible to install the swashplate 8 with a variable inclination, as a result of which the displacement machine 1 has a variable displacement volume.

The cylinder barrel 3 is supported in the axial direction of the displacement machine 1 opposite from the track 7 on a housing-side manifold 10, which forms a control surface 11. The control surface 11 is provided with kidney-shaped control bores that make possible the communication of an inlet channel 14 and an outlet channel 13 in the housing 9 with the piston bores 4.

The manifold 10 can be formed by a disk-shaped component non-rotationally fastened to the housing 9, for example, a housing cover 9*a* of the housing 9. Alternatively, the manifold 10 can be formed in one piece onto the housing 9, for example, a housing cover 9*a* of the housing 9, so that the function of the control surface 11 is integrated into the housing 9, 9*a*.

The control surface 11 can be flat as illustrated in FIG. 1 but it can also be spherical.

The slippers 6 are each connected with the respective pistons 5 by a slipper linkage 20 in the form of a ball and socket joint.

Running through the cylinder barrel 3 is a central boring through which a drive shaft 21 extends. The drive shaft 21 is oriented concentric to the axis of rotation 2. The drive shaft 21 is rotationally mounted in the housing 9, 9*a* by bearings 22, 23.

The cylinder barrel 3 is non-rotationally connected (but axially displaceable) with the drive shaft 21 by a drive toothing 24. A hold-down spring 25 presses the cylinder barrel 3 in the axial direction against the control surface 11 and supports it.

Between the end surface of the rotating cylinder barrel 3 and the housing-side manifold 10 of the displacement machine 1, there is a sliding contact bearing area. In order to reduce friction and wear on this sliding contact bearing area, a metal bearing layer L made of a tribologically advantageous bearing metal material, such as a non-ferrous metal or a non-ferrous metal alloy, is arranged on the end surface of the cylinder barrel 3.

Figure 2:
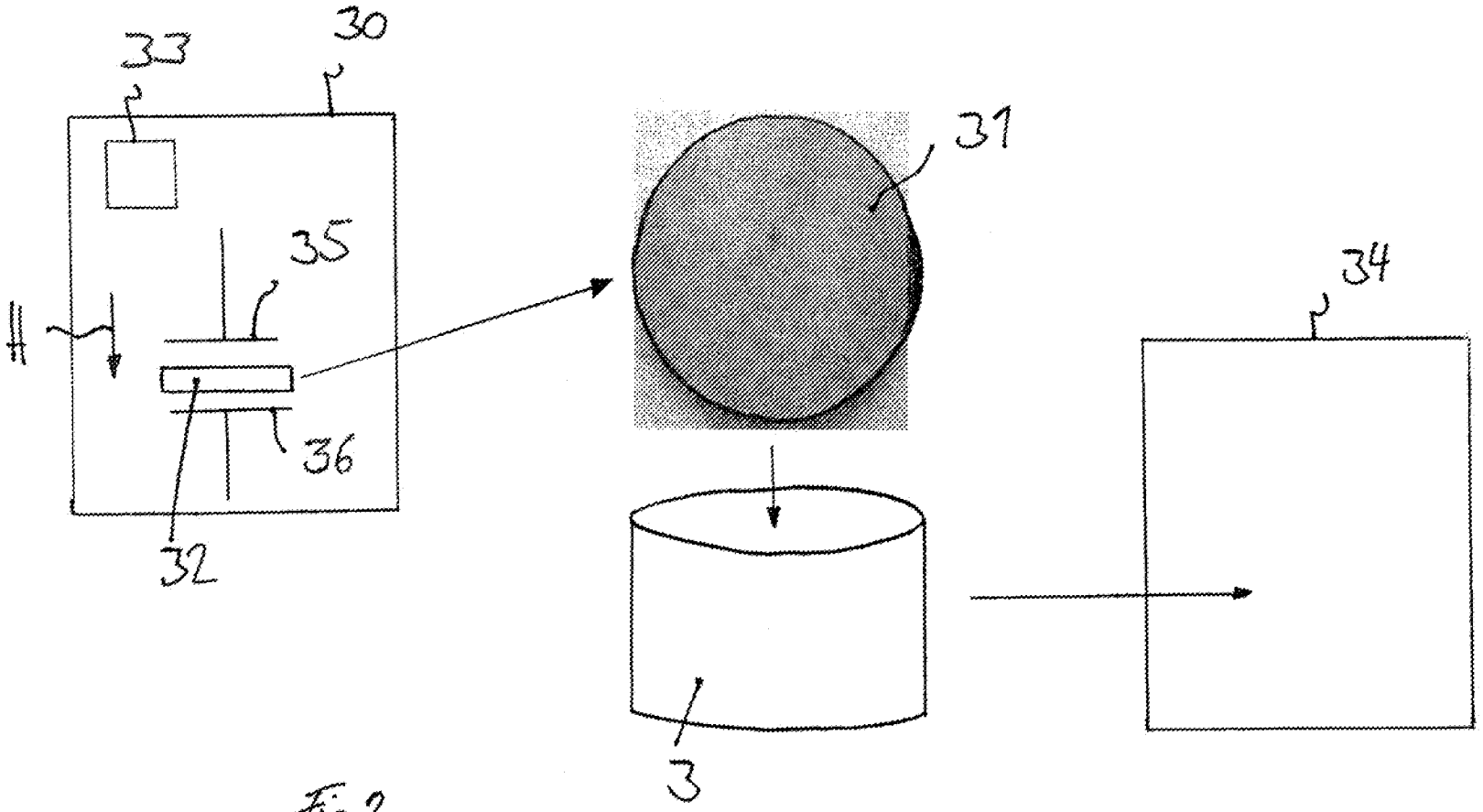
FIG. 2 is a schematic diagram of the method of the invention for production of a metal bearing layer on the cylinder barrel of the displacement machine.

As illustrated in FIG. 2, in a first production step in a cold press 30, a dimensionally stable, disk-shaped green compact 31 is produced from a sintering powder, preferably a sintering bronze powder that is dry and free of additives, by a cold pressing process at high pressure. The green compact 31 forms a powder tablet.

The cold press 30 comprises a press form 32 into which the dry sintering powder is filled and is then pressed into the green compact 31. The cold pressing process is monitored by a monitoring system 33 with appropriate sensor technology.

The cold press 30 doses an appropriate volume of sintering powder into the press form 32. Then a pressing tool formed by an upper punch 35 and a lower punch 36 is pressurized at a specified pressing force, as a result of which the sintering powder in the press form 32 is compacted at a specified press pressure. The displacement H of the punches 35, 36 of the pressing tool are thereby measured by the cold press 30.

The cold press 30 is constructed so that when there is a variation of the displacement H of the pressing tool at the specified pressing force, the amount of sintering powder measured into the mold for the subsequently produced green compacts 31 is adjusted by increasing or decreasing the fill volume.

In a subsequent second manufacturing step, the green compact 31 produced by the cold pressing process is sintered onto the end surface of the cylinder barrel 3 in a sintering process. The green compact 31 is placed on the end surface of the cylinder barrel 3 and is sintered in a sintering plant 34.

The production method of the invention of the cylinder barrel 3 provided with the metal bearing layer L has a series of advantages.

As a result of the production of the dimensionally stable green compact 31, during the cold pressing and the subsequent placement of the green compact 31 onto the cylinder barrel 3 and the sintering process, only a small amount of dust is generated. Only small losses of sintering powder occur as a result of the generation of dust. The exposure to the dust experienced by the employees involved in the production of the metal bearing layer L on the cylinder barrel 3 is also reduced.

For the cold pressing process, economical dry sintering powder can be used which has good pourability and can be poured uniformly into the specified press form 32 of the cold press 30. A uniform filling of the press form 32 can be achieved. As a result of the monitoring system 33 and corresponding sensor technology, the cold pressing process can be monitored and repeated, as a result of which the quantity of sintering powder used can be reduced by a defined pressing process with few fluctuations. Any variation of the bulk density of the sintering powder can be measured by measuring the displacement of the punches 35, 36 of the cold press 30 until the specified pressing force is reached. Overall, therefore, it becomes possible to achieve a high and uniform quality of the metal bearing layer L on the cylinder barrel 3. The cold pressing process of the green compact 31 also makes short cycle times possible. After the production of the green compact 31, handling for the production of the cylinder barrel 3 is easy because only the green compact 31 needs to be handled and placed on the cylinder barrel 3 for the sintering process.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A method for production of a metal bearing layer on a cylinder barrel of a hydrostatic displacement machine, comprising:

producing a dimensionally stable green compact from a sintering powder by a cold pressing process in a first production step, wherein a press form with a predefined fill volume is filled with the sintering powder in the cold pressing process, wherein a pressing tool comprises an upper punch and a lower punch and is pressurized at a specified pressing force, and wherein the displacement of the pressing tool is measured;

during the cold pressing process, automatically adjusting the amount of sintering powder in the event of a variation of the displacement of the pressing tool at the specified pressing force; and sintering the green compact onto the cylinder barrel of the hydrostatic displacement machine by a sintering process in a second production step, wherein the green compact is cold pressed before being placed in contact with the cylinder barrel.

2. The method as recited in claim 1, wherein the dimensionally stable green compact is produced in the cold pressing process by a cold press.

3. The method as recited in claim 2, wherein a disk-shaped green compact is produced in the cold pressing process.

4. The method as recited in claim 2, wherein the cold pressing process is performed using dry sintering powder.

5. The method as recited in claim 2, wherein a press form with a predefined fill volume is filled with the sintering powder in the cold pressing process.

6. The method as recited in claim 2, wherein in the cold pressing process, the pressing process is monitored.

7. The method as recited in claim 2, wherein the green compact produced in the cold pressing process is placed on an end surface of a cylinder barrel for the sintering process.

8. The method as recited in claim 1, wherein a disk-shaped green compact is produced in the cold pressing process.

9. The method as recited in claim 8, wherein the cold pressing process is performed using dry sintering powder.

10. The method as recited in claim 8, wherein a press form with a predefined fill volume is filled with the sintering powder in the cold pressing process.

11. The method as recited in claim 8, wherein in the cold pressing process, the pressing process is monitored.

12. The method as recited in claim 8, wherein the green compact produced in the cold pressing process is placed on an end surface of a cylinder barrel for the sintering process.

13. The method as recited in claim 1, wherein the cold pressing process is performed using dry sintering powder.

14. The method as recited in claim 13, wherein a press form with a predefined fill volume is filled with the sintering powder in the cold pressing process.

15. The method as recited in claim 1, wherein the green compact produced by the cold pressing process is weighed after the cold pressing process.

16. The method as recited in claim 1, wherein in the cold pressing process, the pressing process is monitored.

17. The method as recited in claim 1, wherein the green compact produced in the cold pressing process is placed on an end surface of a cylinder barrel for the sintering process.

* * * * *